US006256819B1

(12) United States Patent
Maier et al.

(10) Patent No.: US 6,256,819 B1
(45) Date of Patent: Jul. 10, 2001

(54) MULTI-SECTION POSITIONING WHEELCHAIR CUSHION

(75) Inventors: Edmund K. Maier; Richard W. Raburn, both of Simpsonville, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

(21) Appl. No.: 09/010,699

(22) Filed: Jan. 22, 1998

Related U.S. Application Data

(60) Provisional application No. 60/036,037, filed on Jan. 22, 1997.

(51) Int. Cl.[7] ..... A47C 7/18

(52) U.S. Cl. ..... 5/653; 5/653.9; 297/452.26; 297/452.27

(58) Field of Search ..... 5/652, 653, 655.9, 5/901, 731, 736, 740; 297/452.15, 452.21, 452.26, 452.27

(56) References Cited

U.S. PATENT DOCUMENTS

| | | | |
|---|---|---|---|
| D. 326,976 | | 6/1992 | Wickis, Jr. et al. . |
| D. 342,411 | | 12/1993 | Graebe . |
| 2,785,739 | | 3/1957 | McGregor, Jr. et al. . |
| 3,611,455 | | 10/1971 | Gottfried . |
| 3,742,528 | | 7/1973 | Münch . |
| 3,846,857 | | 11/1974 | Weinstock . |
| 3,870,450 | | 3/1975 | Graebe . |
| 4,005,236 | | 1/1977 | Graebe . |
| 4,070,719 | | 1/1978 | Morgan . |
| 4,279,044 | | 7/1981 | Douglas . |
| 4,541,136 | | 9/1985 | Graebe . |
| 4,573,456 | | 3/1986 | Spann . |
| 4,629,246 | | 12/1986 | Fulton . |
| 4,698,864 | | 10/1987 | Graebe . |
| 4,768,251 | | 9/1988 | Baskent . |
| 4,862,538 | | 9/1989 | Spann et al. . |
| 4,901,387 | | 2/1990 | Luke . |
| 4,951,334 | | 8/1990 | Maier . |
| 4,953,913 | | 9/1990 | Graebe . |
| 5,025,519 | | 6/1991 | Spann et al. . |
| 5,052,068 | | 10/1991 | Graebe . |
| 5,079,790 | * | 1/1992 | Pouch ..... 5/653 X |
| 5,111,544 | | 5/1992 | Graebe . |
| 5,144,705 | | 9/1992 | Rogers . |
| 5,152,023 | | 10/1992 | Graebe . |
| 5,163,196 | | 11/1992 | Graebe et al. . |
| 5,252,278 | | 10/1993 | Spann et al. . |
| 5,294,181 | * | 3/1994 | Rose et al. ..... 297/452.27 X |
| 5,352,023 | * | 10/1994 | Jay et al. ..... 5/653 X |
| 5,442,823 | * | 8/1995 | Siekman et al. ..... 297/452.27 |
| 5,459,896 | | 10/1995 | Raburn et al. . |
| 5,522,106 | * | 6/1996 | Harrison et al. ..... 5/653 |
| 5,551,107 | * | 9/1996 | Graebe ..... 5/655 X |
| 5,568,660 | | 10/1996 | Raburn et al. . |
| 5,580,504 | | 12/1996 | Spann et al. . |
| 5,687,436 | * | 11/1997 | Denton ..... 5/653 |
| 5,950,263 | * | 9/1999 | Hanson et al. ..... 5/653 |

FOREIGN PATENT DOCUMENTS 2084867A 4/1982 (GB) .

* cited by examiner

*Primary Examiner*—Michael F. Trettel
(74) *Attorney, Agent, or Firm*—Dority & Manning

(57) ABSTRACT

A foam cushion suitable for use such as with a wheelchair provides a combination of general pressure relief and positioning control over legs of a patient possibly otherwise having reduced or impaired motor control skills. A desired leg position is achieved by separating the legs and supporting them in a generally parallel position. Two base pieces have predetermined upper profiles and are glued to an upper support element having integrated cubic elements for pressure relief. Channels between adjacent cubic elements facilitate flexure of the upper element to conform to the contours of the two base pieces. Relatively high ILD foam characteristics and relatively high foam densities combined with the subject structure give good results for support and for product life, including compression fatigue considerations.

16 Claims, 5 Drawing Sheets

MULTI-SECTION POSITIONING WHEELCHAIR CUSHION

PRIORITY CLAIM

This application is based on Provisional Application having U.S. Ser. No. 60/036,037 filed Jan. 22, 1997, and priority is hereby claimed therefrom.

BACKGROUND OF THE INVENTION

The present invention relates to improved support apparatus and methodology in general, and in particular to improved multi-section foam positioning technology.

A significant problem for immobile patients, such as wheelchair patients or others confined by limited walking ability, is the occurrence of pressure sores and related tissue damage. Hence, there is a general need for pressure relief in such immobile patients.

A particular problem for typical patients in a prolonged seating environment is that the patients may suffer from a loss of motor skills or other abilities to manipulate their legs. This, and other general aspects of their condition, can also lead to positioning problems. For example, the legs of a patient may be excessively abducted (drawn apart or separated) or excessively adducted (drawn together or closed). The more ideal position is for the legs to be separated and generally parallel to one another as they project forwardly from the lower torso of the patient.

As generally well known, the projecting ischial aspect at the base of the spine provides another comfort concern point for long term seated patients.

Another aspect of pressure relief deals not just with the vertical components of pressure, but the lateral or horizontal components, often referred to as shear pressures. Oftentimes, a support arrangement designed to address vertical pressures will address shear or lateral pressure forces less well, or vice versa. Still further, introducing lateral forces for the purpose of controlling leg position, or positioning of other bodily features, raises the possibility of interjecting undesired shear forces.

Yet another aspect of modern health care demands is an issue of providing combinations of advantageous features with an embodiment and technology which is also cost effective.

To an extent, improved pressure dispersion can be achieved with a multi-section approach having respective areas specialized for support of different physical characteristics. See, for example, commonly owned U.S. Pat. No. 4,862,538, entitled "MULTI-SECTION MATTRESS OVERLAY FOR SYSTEMATIZED PRESSURE DISPERSION," the complete disclosure of which is fully incorporated herein by reference. One challenge of the technical aspects of wheelchair cushions and similar environments is finding practical ways to achieve advantageous results in smaller spaces as have been achieved with larger scale technologies designed for full mattress overlays, such as in the above-referenced '538patent.

SUMMARY OF THE INVENTION

The present invention recognizes and addresses various of the foregoing problems, and others, concerning support of long term confined patients, or others for whom improved seating comfort is desired. Thus, broadly speaking, a principal object of this invention is improved cushion technology. More particularly, a main concern is improved apparatus and methodology for multi-section foam positioning cushions.

It is therefore another particular object of the present invention to provide a foam apparatus adapted for simultaneously providing general pressure relief and positioning control for the user.

It is another general object of the present invention to provide an apparatus achieved with methodology which is cost effective, while still achieving advances in practical performance.

Still a further more particular object is to provide an improved foam-based apparatus for comfortably seating long term care patients with their legs guided to an ideal position (i.e., generally separated and parallel to one another).

Additional objects and advantages of the invention are set forth in, or will be apparent to those of ordinary skill in the art from, the detailed description herein. Also, it should be further appreciated that modifications and variations to the specifically illustrated and discussed features, steps, materials, or devices hereof may be practiced in various embodiments and uses of this invention without departing from the spirit and scope thereof, by virtue of present reference thereto. Such variations may include, but are not limited to, substitution of equivalent means, features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, steps, or elements, or their equivalents (including combinations of features or steps or configurations thereof not expressly shown in the figures or stated in the detailed description). One exemplary such embodiment of the present invention relates to an improved apparatus comprised of plural elements, including two respective forward and rear base pieces, having predetermined contoured upper surfaces in support of an upper support element having respective elements for general pressure relief, in contact of a patient seated thereon.

Other aspects of the present exemplary embodiments concern use of plural sections joined to form a base, having respective upper contoured surfaces which are used to transmit the respective contours thereof onto larger, respective support elements integrally formed in an upper support element otherwise adhered to the base elements. With such apparatus and methodology, respective base elements may be efficiently manufactured and joined together to form a composite base having respective sections with different support contours.

Such apparatus and methodology is particularly advantageous for producing a support contour which varies in front to back profile as well as lateral or side to side profile. At the same time, such varying profiles may be advantageously achieved with cutting technology which operates in a single plane (i.e., either front to back or side to side). It is by combining such respective base multiple sections and upper support element that such additional advantage is achieved.

It is to be understood that the present invention applies equally to present methodology in association with manufacturing such improved apparatus as otherwise described herein.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
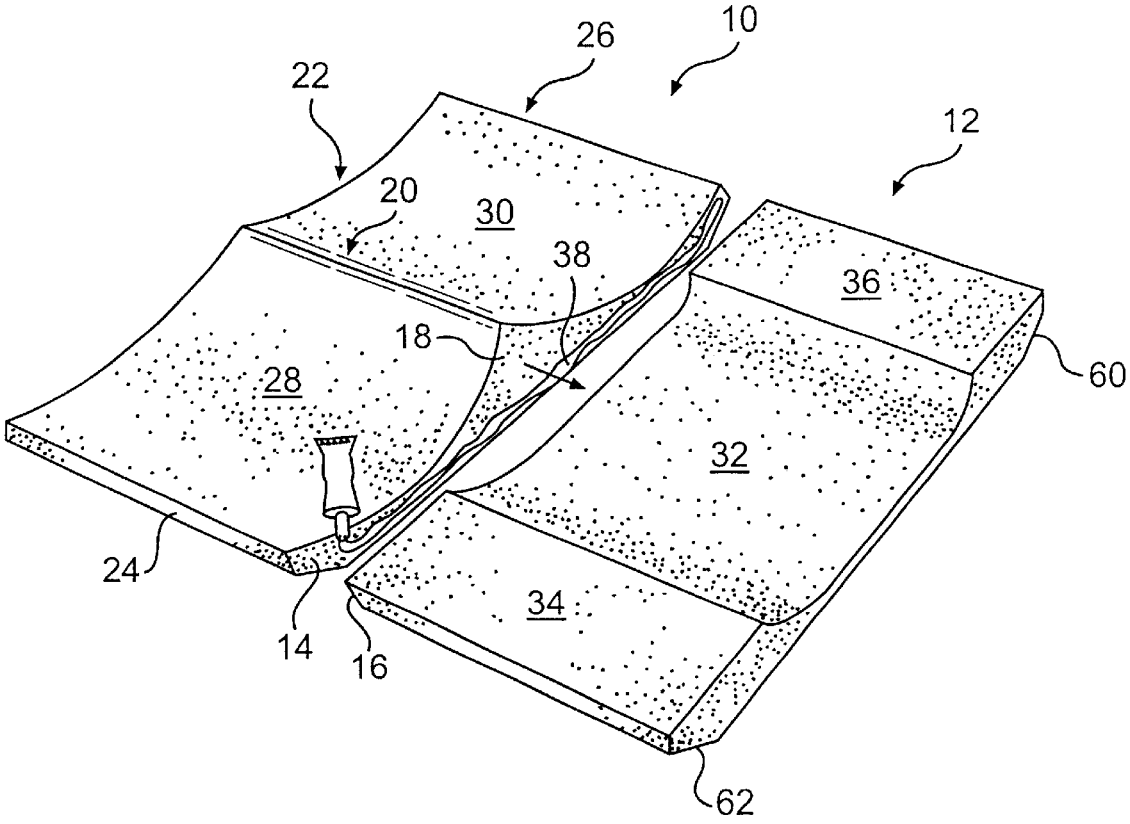
FIG. 1 is a generally top and rear perspective view of exemplary embodiments of two base pieces, forward and rear, respectively, in exploded view before being joined in accordance with the invention.

Repeat use of reference characters throughout the present specification and appended drawings is intended to represent same or analogous features, elements, or steps of the invention.

DETAILED DESCRIPTION OF THE PREFERRED EMBODIMENTS

It is to be understood by those of ordinary skill in the art that the features and aspects of the subject invention, both as to apparatus and methodology as disclosed herein, may be practiced in various embodiments. Hence, the present description of an exemplary preferred embodiment is by way of example only, and not intended to limit the spirit or scope of the subject invention.

FIG. 1 illustrates a generally top and rear perspective view of two base pieces in accordance with an exemplary embodiment of the subject invention. A relatively forward base piece 10 is designed and situated so as to be joined to a generally rearward base piece 12 along respective angled joining surfaces 14 and 16. While various angles may be practiced, an angle in a range of from about 40 degrees to about 60degrees provides an effective gradual sloping to an area generally 18, forming a trailing edge surface of a central or projecting pommel generally 20 associated with the upper surface of base piece 10.

In general, forward edge 22 of base piece 10 is turned towards the forward edge of a supporting wheelchair or similar. As will be understood by those of ordinary skill in the art, sides 24 and 26 comprise left and right, respectively, lateral edges of piece 10, such that regions 28 and 30 of the upper surface of piece 10 respectively support left and right legs of a patient or user of the present embodiment.

Generally rearward base piece 12 has a central reduced area 32 relative to its lateral upper support surfaces 34 and 36. Such reduced region 32 forms an ischial cavity which, together with a general front to rear reduction in the overall height of the apparatus, helps transfer support pressures from the buttocks and ischial area to the lower surfaces of the legs received above support areas 28 and 30.

Those of ordinary skill in the art will appreciate that various commercial glues generally 38 may be applied between adjacent contact surfaces 14 and 16 so as to join the foamed material together.

Collectively, the respective surface profiles of the forward base piece 10 and rearward base piece 12 define an overall predetermined contoured approach to support of a patient thereon. However, it is preferred that a further support element be interposed between a patient and such upper surfaces of base elements 10 and 12.

Figure 2:
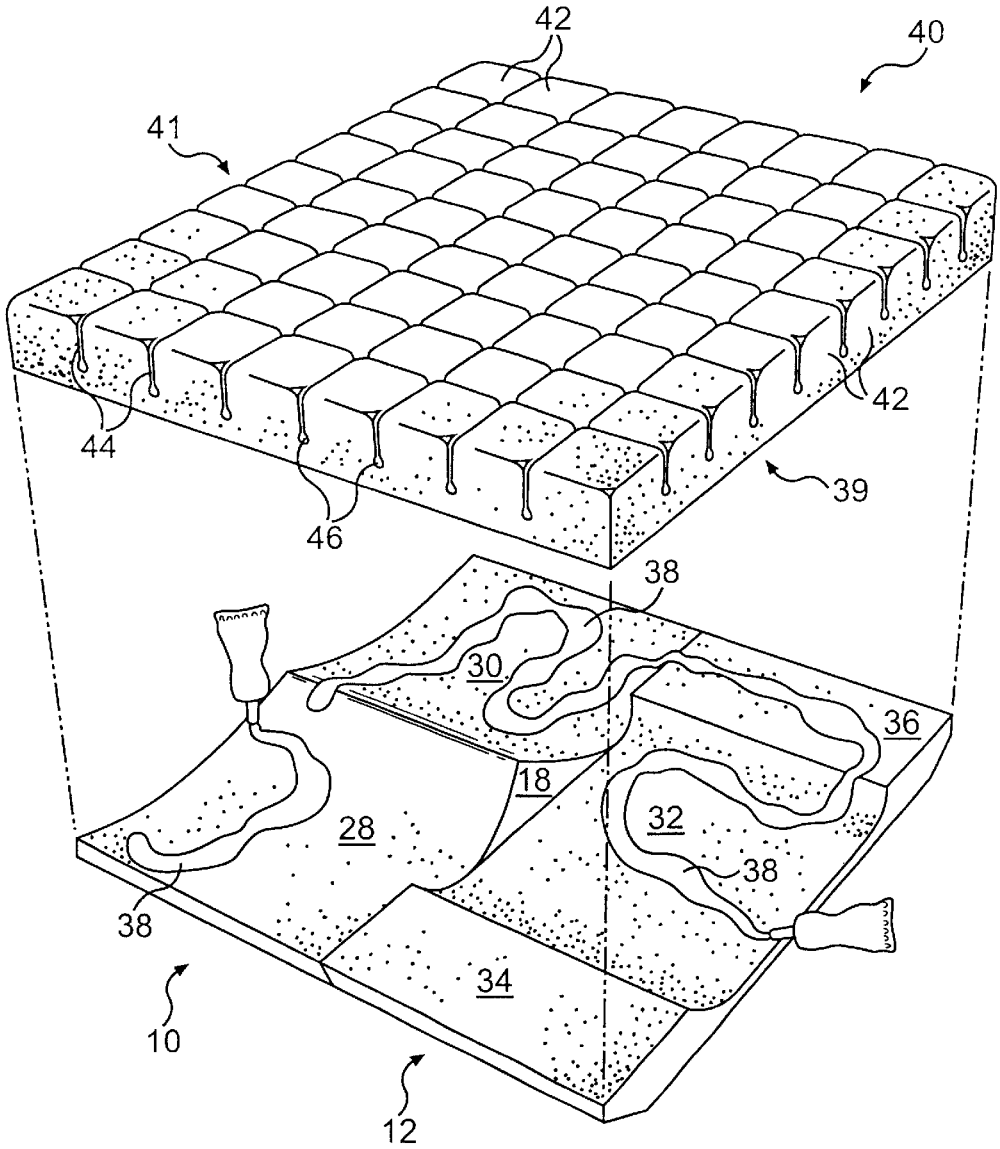
FIG. 2 is a generally top and rear perspective view as in FIG. 1, but with the base pieces joined, and illustrating thereabove in exploded view an exemplary upper support element to be further joined to such two base pieces in accordance with this invention.

More particularly, FIG. 2 represents bonding of an upper support element generally 40 to the respective upper surfaces of base elements 10 and 12 as referenced above. As represented in the generally top and rear perspective view of present FIG. 2, various commercially available glues 38 or similar may be simply used between mutual contact surfaces for adhering element 40 to the respective base elements 10 and 12. As shown, element 40 has relatively flat lower and upper surfaces 39 and 41, respectively, prior to being secured to base elements 10 and 12.

While various thicknesses may be practiced, the nominal thickness or "height" of upper support surface 40 is preferably about two inches, while the nominal thickness of the respective base elements 10 and 12 is preferably about one inch.

Figure 3:
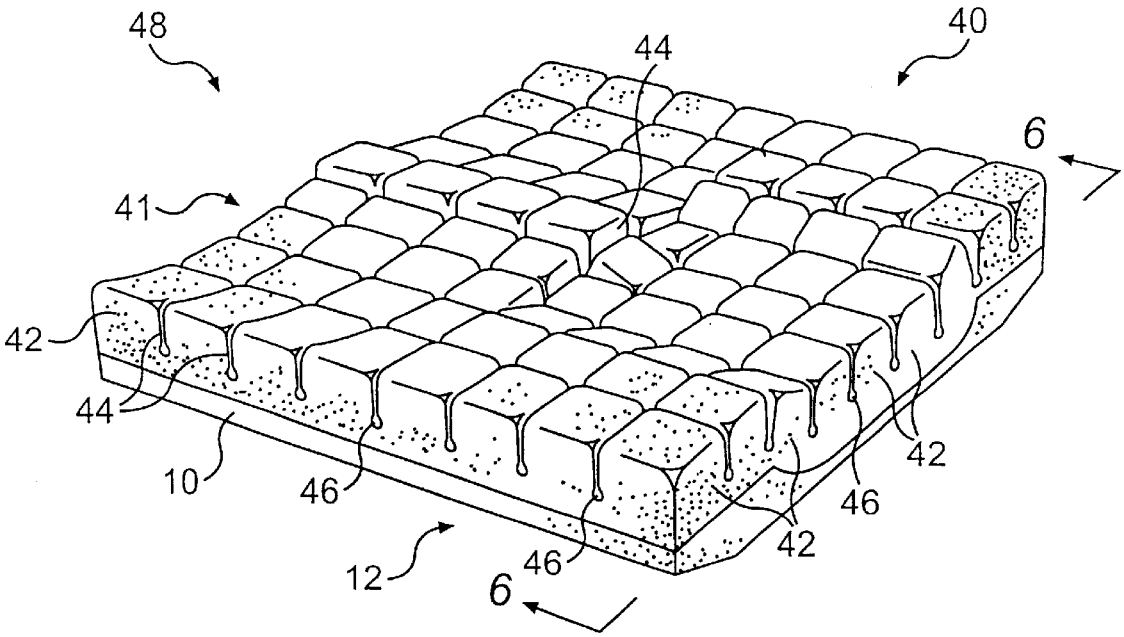
FIG. 3 is a generally top and rear perspective view similar to that as in present FIGS. 1 and 2, but with the respective exemplary base pieces and upper support element joined in accordance with the invention.

FIG. 3 represents an exemplary completed combination of upper support element 40 with base elements 10 and 12. As may be seen in such generally top and rear perspective view, the previously relatively flat support element 40 has now assumed the contours of the respective base pieces 10 and 12. With such approach, a readily manufactured element such as support element 40 is transformed into a much more complex support morphology, as well illustrated in present FIG. 3.

FIG. 3 also represents a preferred embodiment of support element 40, comprising an integral arrangement of adjacent protrusions 42. As shown, preferably a plurality of such protrusions may be provided in generally cubic form, with cuts 44 defined therebetween, and further preferably with channels or ringed openings generally 46 formed in the bottom of the respective cuts 44. As illustrated, operation of such cuts 44 and channels 46 very effectively enable the upper surface 41 of upper support element 40 to be contoured in accordance with the lower support pieces 10 and 12, while the respective independent support elements 42 are substantially maintained in a generally vertical position, relative to the horizontal plane of the overall apparatus 48 in accordance with the subject invention. It is to be understood that different numbers and/or sizes of such elements 42, and different depths of cuts and radius of curvature for channels 46 may be practiced, generally in keeping with the subject invention.

Figure 4:
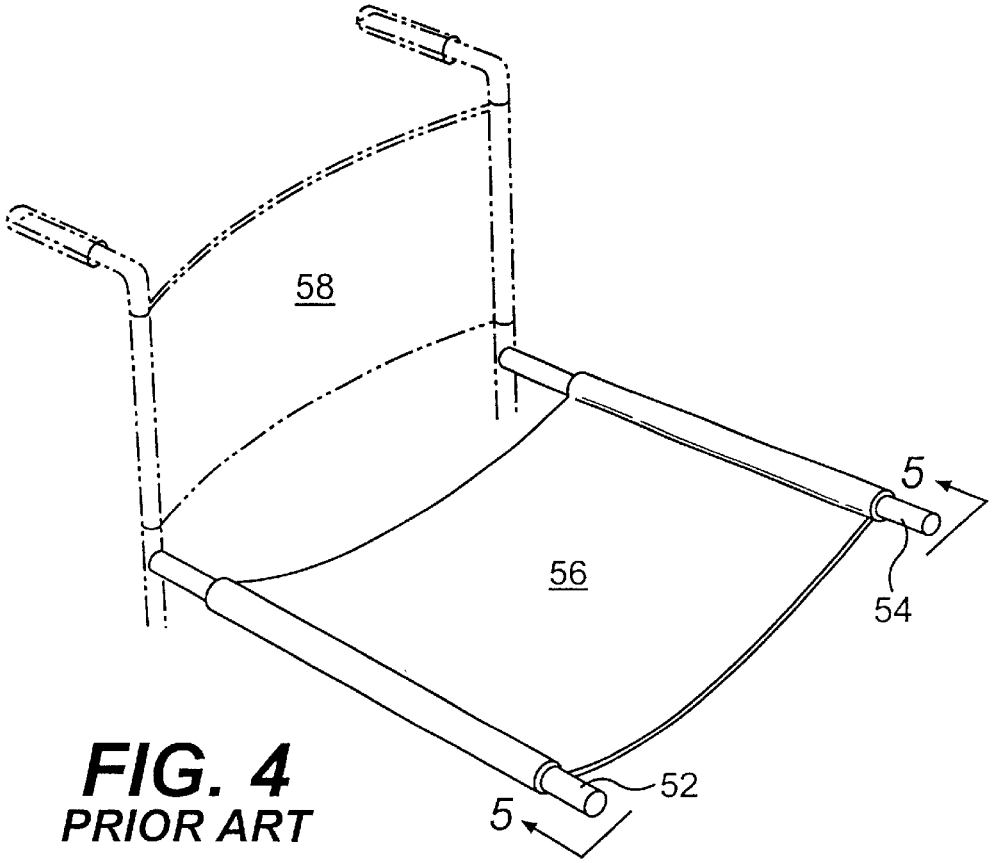
FIG. 4 PRIOR ART
FIG. 4 is a generally top and front perspective, partial view of a typical conventional wheelchair sling-type seat arrangement, such as with which the present invention may be practiced.

FIG. 4 shows a generally top and front perspective view of a typical conventional wheelchair configuration generally 50, having respective lateral support bars 52 and 54, and with a sling-type seat generally 56 supported therebetween. Such arrangement is most typical in relation to folding wheelchairs. The back support generally 58 may be similarly provided for folding, as illustrated, and as well known to those of ordinary skill in the art.

Figure 5:
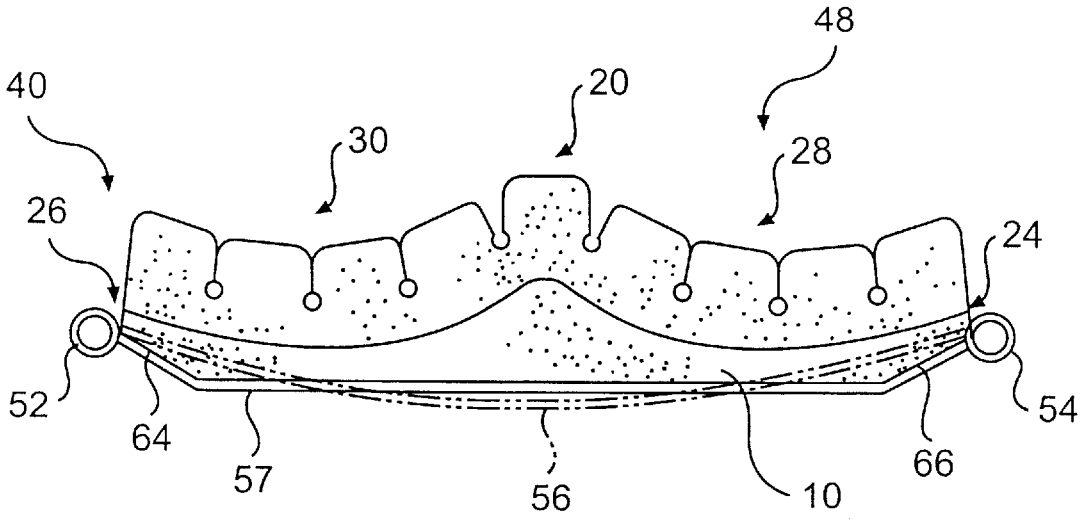
FIG. 5 is a generally front elevational view of an exemplary embodiment of the subject invention as would be seen per the view line 5—5 indicated in present FIG. 4, when used with the typical wheelchair configuration generally and partially represented.

FIG. 5 shows a generally front elevational view of an exemplary embodiment generally 48 of the subject invention used in combination with a typical underslung wheelchair support 56, generally as seen along the view line 5—5 of present FIG. 4. As shown in such FIG. 5, the central ridge or pommel 20 is prominent, as are the respective support areas 28 and 30 for receiving the user's legs. With such arrangement, the pommel element 20 abducts the user's legs, while the respective lateral edges 26 and 24 of the base elements combine with the upper support element 40 to provide desired adduction of the user's legs to prevent them being excessively splayed open.

Figure 6:
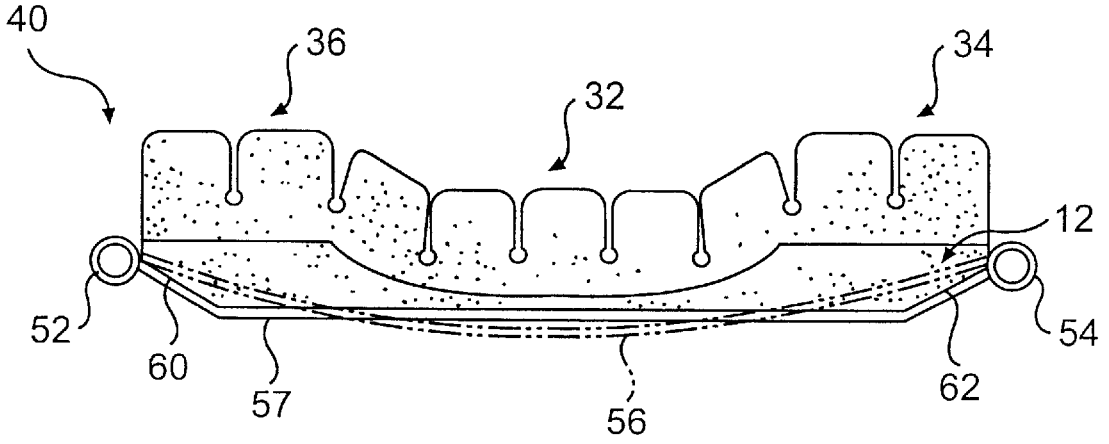
FIG. 6 is a rear elevational view of an exemplary embodiment of the present invention, focused on the foreground aspects of such view as would be seen per the view line 6—6 indicated in present FIG. 3, and also representing (partially) use thereof with a typical conventional wheelchair.

FIG. 6 illustrates a generally rear elevational view of the apparatus as illustrated in present FIG. 5, but with only the foreground portions of the upper support element 40 illustrated for the sake of clarity. As illustrated, the prominent rearward feature is the resulting depressed area 32 and relative higher regions 34 and 36, which result from the profile of the generally rearward base piece 12, as referenced above. Together they help form an ischial receiving area and help position the patient or user accordingly.

Both FIGS. 5 and 6 show an additional aspect of an exemplary feature preferred for wheelchair embodiments of the subject invention for use with typical wheelchair arrangements such as illustrated in present FIG. 4. Such features are shown by the angled lower cut edges 64/66 and 60/62 adjacent lateral portions of respective base pieces 10 and 12. Such lateral or angle cut surfaces 60/62 and 64/66 facilitate adaptation of the device generally 48 when under pressure between a user and the generally curved lower-slung support surface 56 of wheelchair 50. Outline 57 shows the position which the bottom of apparatus 48 and the sling seat 56 would tend to take on if there were no pressure from a user. Seat 56 is shown in dotted line in both FIGS. 5 and 6, representing the position assumed generally by both the seat 56 and the bottom of apparatus 48 when in use, i.e., when under loading pressure.

Figure 7:
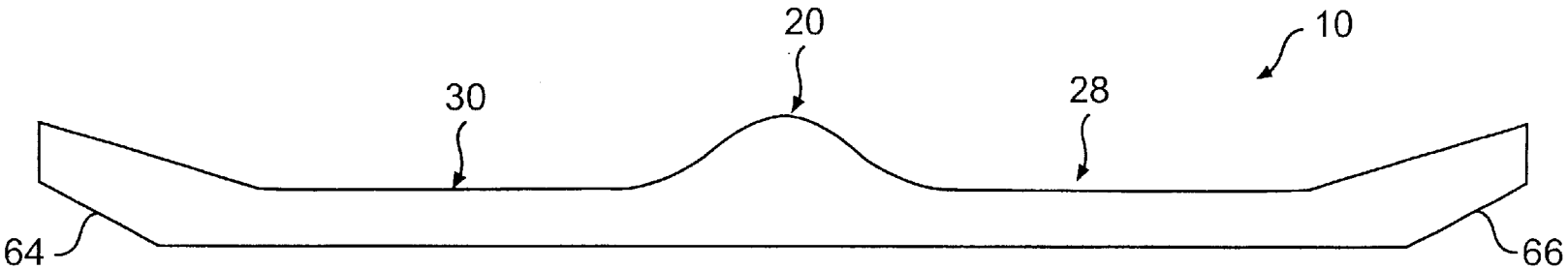
FIG. 7 is a generally front elevational view of the forward base element as otherwise represented in the present exemplary embodiment of the subject invention.

FIG. 7 illustrates a front elevational view of an exemplary generally forward base element 10. The central pommel generally 20 resides between regions 28 and 30. Angled edges 64 and 66 are also provided generally for alignment with and function similar to cut edges 60 and 62 of base piece 12, as referenced above.

Figure 8:
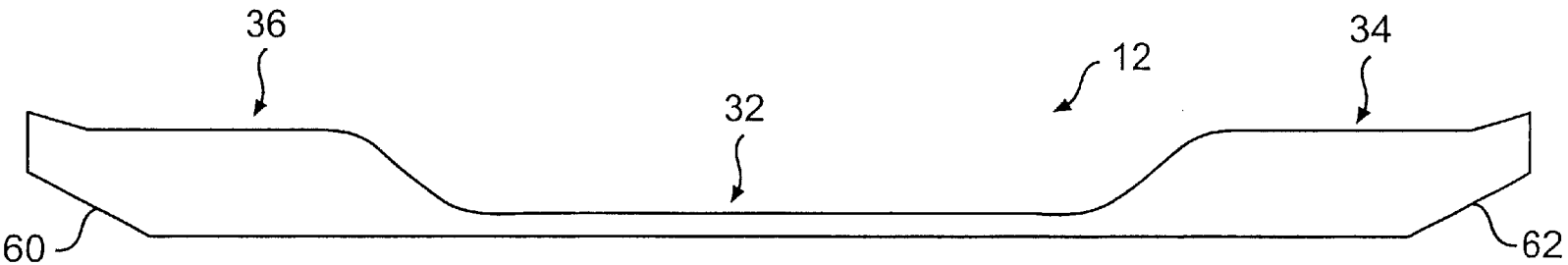
FIG. 8 is a rear elevational view of the rearward base element otherwise represented in the present exemplary embodiment of the present invention.

A rear elevational view of the rearward base element 12 is represented in present FIG. 8. Such FIG. 8 also shows the relative different thickness regions 32, 34, and 36 of such base piece 12.

As will be further understood by those of ordinary skill in the art from the collective disclosure herewith, there are different surface profiles achieved on a front to back basis with practice of the subject invention, as well as different lateral surface profiles. The invention, in a cost effective manner, provides simultaneous variations in both front to back and lateral modes, with such surface translations being transmitted to an otherwise generally flat upper support element.

Another advantage of practice of the present invention, both apparatus and methodology, is that the center pommel abducts the legs, but without any abduction pressures being carried to the rear quarters of the patient, due to the split profile feature.

It will be further understood by those of ordinary skill in the art that the two piece base simultaneously provides a filler for support structure while also serving as a base for contoured support of the upper support element. Such combination may be formed through use of variously commercially available glues, such as for use with open cell polyurethane materials.

As referenced above, the collective target nominal thickness of an exemplary preferred embodiment would be about three inches. While different cubes or other shapes may be practiced, an approximate two inch square nominal element (including gaps therebetween) could be used on the upper surface of element 40.

Generally longer life of the product is obtained from preferably higher rated materials used. For example, to provide an overall device having dimensions of about 16 inches by 18 inches, and with a nominal three inch thickness, certain foam densities and ILD characteristics are preferred. ILD characteristic is the indentation load deflection of the foam body, and is defined as the number of pounds of pressure needed to push a 50 square inch circular plate into such main body an amount adequate to deflect such body a given percentage distance of its non-loaded thickness. For example, a 25% ILD rating would be the number of pounds of pressure needed to push a 50 square inch circular plate into the foam body to a point only 75% of its original thickness.

In the present exemplary embodiment, upper foam support element 40 may preferably have a density of about 2.8 pounds per cubic foot and a 25% ILD rating of about 55 pounds or higher. Such relatively higher readings provide good support and product life, especially against compression fatigue. It is to be understood that some variations in such numbers, resulting in an acceptable range, may be practiced in accordance with the invention, so long as relatively higher ranges are maintained. For example, a product with a 25% ILD characteristic lowered to about 35 pounds may under certain circumstances suffer "bottoming out," which is a condition which fails to provide the desired patient support.

Similarly, the two base pieces may be provided with preferred characteristics which are in relatively higher ranges. Preferably, the two base pieces are of the same foam material, though differences could be practiced. When of the same material, a foam density of about 2.4 pounds per cubic foot and a 25 percent ILD characteristic of about 125 pounds or higher is preferred in some embodiments. The 25% ILD characteristic may also be stated in a range, with the low end of such range being generally down to about 90 to 100 pounds. Preferably, the density is maintained at at least 2.0 pounds per cubic foot, with higher densities also falling within the spirit and scope of the subject invention, so long as performance is maintained.

In addition to variations in the foam characteristics, dimensional variations may be practiced. Preferably, the base elements 10 and 12 have a nominal height of about 1 inch, tapering to 0.25 inches in the rear (central region 32 of base element 12). The pommel 20 or raised central point of forward base piece 10 may be about 1.5 inches thick, while the adjacent "valley" depth for areas 28 and 30 may be about 0.5 inches. In general, the front thickness of the base pieces is greater than at the rear, to help form the ischial pocket in region 32. As understood by those of ordinary skill in the art, the contour of upper support element 40 then generally conforms with the contours of the respective base pieces 10 and 12.

It is to be further understood that such upper support element 40 may be comprised of different embodiments than presently illustrated, combined with the same or different base pieces 10 and 12. With such variations, different combinations of various respective embodiments of pieces 10, 12, and 40 may themselves comprise different embodiments of the subject inventive apparatus 48 for use with a wheelchair 50 or in other desired support arrangement.

Also, different numbers of multiple sections (upper support elements or base pieces) may be joined together in some embodiments. As will be understood, the use for example of three base pieces obtains additional opportunities for varying the resulting complexity of the support profile of upper element(s) 40.

It is to be further understood that variations and modifications not shown, such as wheelchair cushion covers or the like, may be practiced as desired or practical, so long as not to interfere with the advantageous functions of the subject invention herein otherwise described.

The foregoing presently preferred embodiments of both apparatus and methodology are exemplary only, and the attendant description thereof likewise is by way of words of example rather than words of limitation, and their use, does not preclude inclusion of such modifications, variations, and/or additions to the present invention as would be readily apparent to one of ordinary skill in the art, the full scope of the present invention being otherwise set forth throughout the present specification.

What is claimed is:

1. A multi-section resilient positioning cushion for support of a patient thereon, said cushion including a forward base piece with a lower surface and an upper surface, and a rearward base piece with a lower surface and an upper surface, said upper surface of said forward and rearward base pieces sections being configured to define a predetermined contoured surface for support of said patient, wherein said contoured surface varies in side to side profile, so as to define respective curved regions for respectively receiving and abducting a patient's legs so that such legs are separated and generally parallel to one another.

2. A multi-section resilient positioning cushion as in claim 1, wherein said contoured surface varies in front to back profile, so that abduction pressures are not carried to the rear quarters of the patient.

3. A multi-section resilient positioning cushion as in claim 1, and further including a support element interposed between the upper surfaces of said forward and rearward base pieces and the patient, said support element having a lower surface in engagement with said upper surfaces of said forward and rearward base pieces, and an upper surface for engagement with the patient when seated thereon.

4. A multi-section resilient positioning cushion as in claim 3, wherein said support element conforms to the surface profiles of the forward and rearward base pieces.

5. A multi-section resilient positioning cushion as in 4, wherein said support element comprises an integral arrangement of adjacent protrusions.

6. A multi-section resilient positioning cushion as in 5, wherein said upper surface of said support element is contoured in accordance with the upper surfaces of the forward and rearward base pieces and respective of said protrusions are substantially maintained in a generally vertical position relative to the horizontal plane of the overall cushion.

7. A multi-section resilient positioning cushion as in claim 1, wherein said forward and rearward base pieces are secured together.

8. A multi-section resilient positioning cushion as in claim 7, further comprising an upper support element, said upper support element configured on said upper surfaces of said base pieces and conforming to their predetermined contours.

9. A multi-section resilient positioning cushion as in claim 8, wherein said upper support element is secured to said forward and rearward base pieces.

10. A multi-section resilient positioning cushion for support of a patient thereon, said cushion comprising:

a forward base piece including a lower surface and an upper surface, said upper surface having a predetermined contour;

a rearward base piece including a lower surface and an upper surface, said upper surface having a predetermined contour; and an upper support element, said upper support element configured on said upper surfaces of said base pieces and conforming to their predetermined contours;

wherein said forward base section upper surface includes first and second curved leg supporting areas for supporting a user's legs separated and generally parallel to one another.

11. A multi-section resilient positioning cushion as in claim 10, wherein said rearward base piece includes a central reduced thickness area relative to lateral upper support surfaces for receipt of the patients buttocks.

12. A multi-section resilient positioning cushion as in claim 10, wherein said forward base section upper surface includes a central projecting pommel.

13. A multi-section resilient positioning cushion as in claim 10, wherein said forward and rearward base sections are secured together.

14. A multi-section resilient positioning cushion as in claim 13, wherein said upper support element is secured to said forward and rearward base sections.

15. A multi-section resilient positioning cushion as in claim 10, wherein said forward and rearward base sections are secured together along respective angled joining surfaces.

16. A multi-section resilient positioning cushion for support of a patient thereon, said cushion comprising:

a forward base piece including a lower surface and an upper surface, said upper surface having a predetermined contour;

a rearward base piece including a lower surface and an upper surface, said upper surface having a predetermined contour; and an upper support element, said upper support element configured on said upper surfaces of said base pieces and conforming to their predetermined contours;

wherein at least one of said forward and rearward base sections includes angled lower cut edges to facilitate adaption of the cushion when under pressure between a patient and the generally curved lower-slung support surface of a wheelchair.

* * * * *